US006352303B1

(12) United States Patent
Hope

(10) Patent No.: US 6,352,303 B1
(45) Date of Patent: Mar. 5, 2002

(54) ARM REST MOUSE PAD

(76) Inventor: James Keith Hope, 2269 Rigney La., Las Vegas, NV (US) 89115

( * ) Notice: Subject to any disclaimer, the term of this patent is extended or adjusted under 35 U.S.C. 154(b) by 0 days.

(21) Appl. No.: 08/938,844

(22) Filed: Sep. 26, 1997

(51) Int. Cl.[7] ..... A47C 7/68

(52) U.S. Cl. ..... 297/188.18; 248/918; 297/188.2; 297/188.21

(58) Field of Search ..... 248/118, 118.3, 248/118.5, 918, 289.11, 205.2; 297/411.23, 411.35, 411.36, 188.2, 188.21, 188.18, 188.14, 153, 160

(56) References Cited

U.S. PATENT DOCUMENTS

| | | | | | |
|---|---|---|---|---|---|
| 2,617,473 | A | * | 11/1952 | Krimstock et al. | 297/118.18 X |
| 3,194,600 | A | * | 7/1965 | Junkunc | 297/160 |
| 3,216,764 | A | * | 11/1965 | Junkunc | 297/160 |
| 3,239,272 | A | * | 3/1966 | Wilkins | 297/160 |
| 3,586,368 | A | * | 6/1971 | Guild | 297/188.18 X |
| 4,339,061 | A | * | 7/1982 | Dunn | 297/118.18 X |
| 4,662,676 | A | * | 5/1987 | Havelock | 297/160 |
| 5,203,845 | A | | 4/1993 | Moore | 248/118 |
| 5,311,210 | A | | 5/1994 | O'Brien et al. | 345/168 |
| 5,334,186 | A | * | 8/1994 | Alexander | 248/205.2 X |
| 5,474,272 | A | * | 12/1995 | Thompson et al. | 297/188.18 X |
| 5,490,710 | A | | 2/1996 | Dearing et al. | 297/162 |
| 5,556,061 | A | | 9/1996 | Dickie | 248/51 |
| 5,683,136 | A | * | 11/1997 | Baumann et al. | 297/160 X |
| 5,727,759 | A | * | 3/1998 | Christensen | 248/118.3 X |
| 5,848,773 | A | * | 12/1998 | Bourassa | 248/918 X |

* cited by examiner

*Primary Examiner*—Leslie A. Braun
(74) *Attorney, Agent, or Firm*—Patent & Trademark Services; Thomas Zack; Joseph H. McGlynn

(57) ABSTRACT

A removable computer mouse and pad support platform attachable to either one of a chair's armrests. The platform has a main support portion for the mouse/pad and an extension arm extending therefrom parallel to the armrests. To attached the platform to one of the armrests, the platform extension arm is oriented parallel to the chair's armrest and one wide strap or two spaced straps are used to encircle and fix it around the armrest. The strap or straps may have hook and loop (VELCRO™) ends or the like which acts as end fasteners. When not made as in the preferred unitary structure embodiment, the two piece main support platform and its lower extension arm may be attached together with screws, bonding material or other fasteners.

1 Claim, 1 Drawing Sheet

ARM REST MOUSE PAD

BACKGROUND OF THE INVENTION

The recent surge in the user of personal home computers having inputs controlled by actuating mouse buttons or mouse movements is well known. In most cases these mouse units are moved along the upper surfaces of supporting pads located either to the user's right or left, depending on whether a person is right or left handed, which pads are in turn supported by an underlying platform such as used to support the keyboard input. Such keyboard platforms supports may also be the top surface of a desk on which the keyboard and computer rest. When it is desired to conceal the platform when not in use, the platform be may mounted on depending table side rails that extended from under the overhead desk surface or retracted under it on the rails. All such mouse and keyboard supporting surfaces are known.

When there is no specifically designed computer mouse supporting surface, the user must either place the mouse/pad on the computer desk or a nearby supporting table, desk, etc. if such is readily available. With the present invention the mouse and pad are supported on the arm rest of the user's chair such their support surface may be moved to a user's position or moved to a different non-use position out of the way as further described herein.

DESCRIPTION OF THE PRIOR ART

Computer mouse supports are known. For example, in U.S. Pat. No. 5,203,845 to Moore the supporting surface has a rear end in an upwardly inclined orientation with a wrist/palm support in cooperation with the forward end. The invention to O'Brien et al. (U.S. Pat. No. 5,311,210) discloses an ergonomic keyboard and operator's chair having a pair of adjustable arm with half of a standard QWERTY keyboard on each armrest. The swing arm chair in the Dearing et al. invention (U.S. Pat. No. 5,490,710) describes a writing table positioned next to a chair's arm that can be moved from a working horizontal position to a vertical fold down storage position next to the armrest. And in U.S. Pat. No. 5,556,061 to Dickie a mouse pad apparatus having a molded base, a pad and a cord retainer is disclosed. In contrast to these prior art references and the known prior art, the present invention provides for a mouse and pad supporting structure that is removably mounted on the armrest of a chair to permit its attachment to either the right or left armrest all as more further set forth in this specification.

SUMMARY OF THE INVENTION

This invention relates to a removable support platform for a chair's armrest on which a mouse and its pad may be placed. To attached the platform to the armrest, the platform extension oriented parallel to the armrest has one or two spaced straps that can encircle the chairs arm and be fixed thereon. The strap or straps each may have hook and loop (VELCRO™) ends or the like. Screws or other strap retainers extend into the strap through the platform's extension member to fix the members together.

It is the primary object of the present invention to provide for an improved removably armrest mounted supporting apparatus for a computer mouse and its pad.

Another object is to provide for such an apparatus wherein the platform may have a variety of armrest retaining members.

These and other objects and advantages of the present invention will become apparent to readers from a consideration of the ensuing description and the accompanying drawings.

DESCRIPTION OF THE PREFERRED EMBODIMENT

Figure 1:
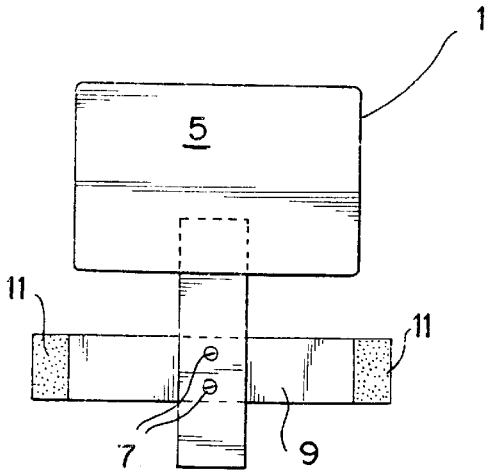
FIG. 1 is a top view of the invention's preferred embodiment.

As shown in FIG. 1, the planar main support platform member 1 has fixed to it near its center a smaller elongated extension arm 3. The extension arm is fitted under the main platform member 1 and fixed to it from underneath using a one piece design. The main platform and its extension form a T-shaped apparatus having smooth exterior surfaces on whose upper main planar support surface 5 a conventional computer mouse and its pad may rest. Attached to the underside of the extension arm 3 by two spaced screws 7 is a wide single padded soft strap member 9 which is oriented at a right angle to the arm. The two opposite ends 11 of strap member 9 may have fastening hook and loops ends (e.g., VELCRO™) which permit the straps when wrapped around a chairs arm rest to be fastened thereto. A pad covering the upper surface of arm extension 3 may be added to insure comfort to the forearm of a user.

Figure 2:
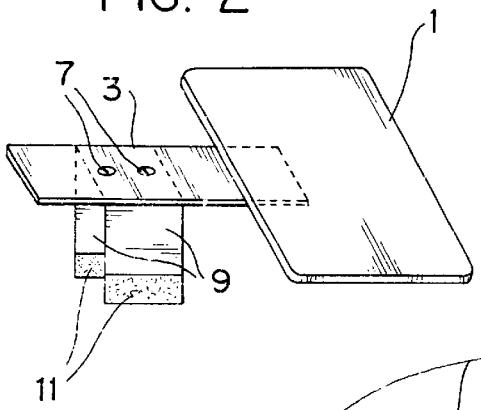
FIG. 2 is a side perspective view of the FIG. 1 embodiment.

FIG. 2 is a side perspective view of the FIG. 1 embodiment. As shown, the extension arm 3 fits under the main mouse and pad support platform 1. It may molded together with the platform as a unitary structure, such as in the plastic injection molding process, or attached to it from underneath as separate member. The wide strap 9 has sufficient width to wrap around several inches of the length of a typical chair's armrest. This insures a firm grip to the arm when the hook and loop ends 11 are engaged around the armrest. To remove the armrest for storage or to place it on the opposite chair armrest, one need simply pull the straps ends from engagement with each other.

Figure 3:
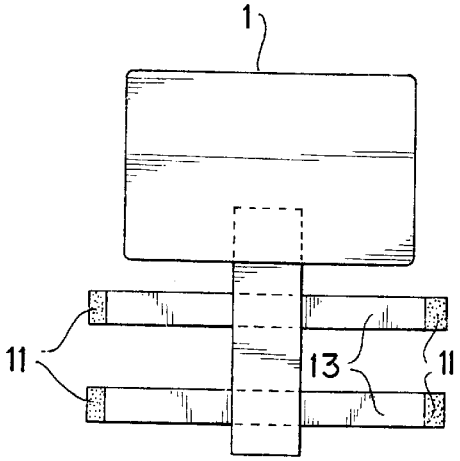
FIG. 3 shows a top view of another embodiment having two spaced armrest retaining straps.

FIG. 3 shows a top view of another embodiment having two spaced armrest retaining straps. Parts that are the same as in the first embodiment have the same numbers. The essential difference between this embodiment and that of the preferred first embodiment is that two spaced armrest retaining straps 13 are fastened to the extension arm 3 along its length. Each of these straps has hook and loop ends 11 which can wrap around the chair's armrest.

Straps 9 or 13 may be made of an elastic resilient material and have buckle or other conventional end fasteners in place of the preferred hook and loop members.

Figure 4:
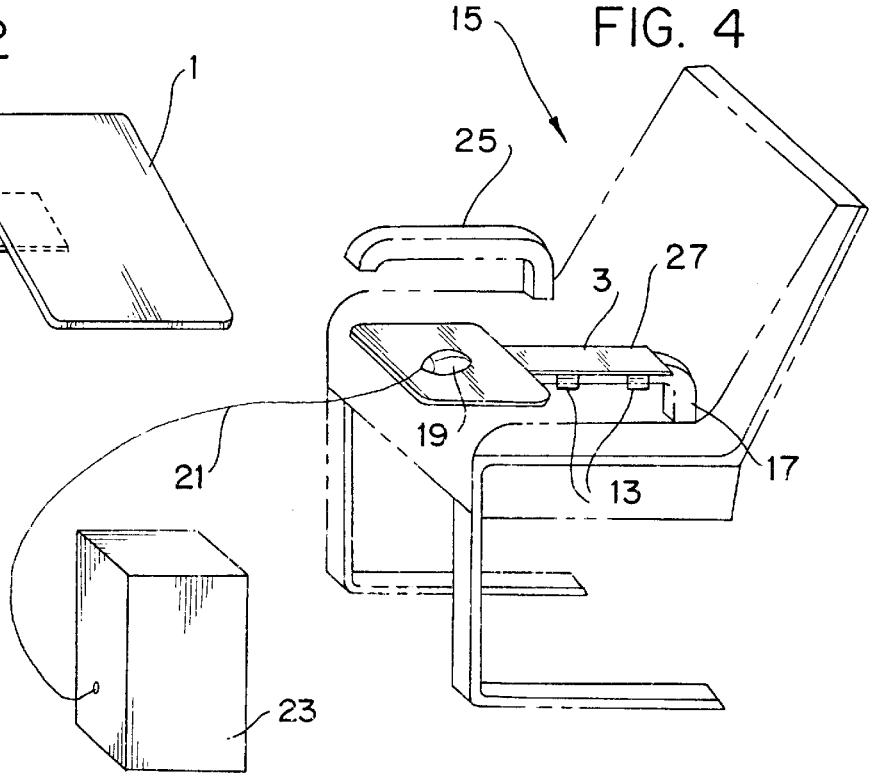
FIG. 4 shows the second embodiment mounted to the a chairs left armrest.

FIG. 4 shows the second embodiment being mounted to the a chair's left armrest. The preferred or first embodiment would be mounted in the same manner. The arm extension 3 is positioned parallel to the armrest's length while the spaced strap members 13 shown are about to be fastened around the chairs 15 left armrest 17. This is the setup when a left handed user is using the computer mouse 19 with supporting lower pad 20. The mouse is linked by cable 21 to the connected computer tower 23. For a right handed user the arm extension 3 would be oriented parallel to the opposite right side armrest 25, and its strap or straps fastened around it with the left armrest. When the mouse's cable 21 is connected directly to the input of a computer, such as the rear input terminal of a desk top computer, the cable would be appropriated oriented to do so.

Clearly other refinements and variations on this basic design are possible. The smooth planar main platform 1 could have surface indentations to restrain the pad's movement. The platform and its extension arm could be other than its shown rectangular shapes in FIG. 1. For example, the extension arm 3 could be a cylindrical rod extending into the main platform 1 or attached to it or molded into it. A padded armrest 27 may be mounted on the extension arm along its length to provide comfort to a user.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A combined chair, support platform and computer mouse comprising:

a chair having a right side armrest and an opposite left side armrest;

a substantially flat support platform removably attached to one of said armrests, said platform having a main portion and an arm extension portion extending from the main portion;

removable strap fastener means including two spaced stap members each attached to the arm extension portion, each strap fastener having hook and loop end fasteners and mounted on the arm extension portion of said platform to fasten the platform to the chair armrest, a padded armrest mounted on the arm extension portion, and a computer mouse mounted on the platform's main portion and adapted to be connected to a computer.

* * * * *